US009739119B2

(12) United States Patent
Garr et al.

(10) Patent No.: US 9,739,119 B2
(45) Date of Patent: Aug. 22, 2017

(54) PENETRATOR FOR A PUNCTURE COMMUNICATION TOOL AND METHOD

(71) Applicants: Ronald J. Garr, Inola, OK (US); Brett C. Jones, Broken Arrow, OK (US); John D. Lindemann, Broken Arrow, OK (US); Michael L. Hair, Tulsa, OK (US); Thomas S. Myerley, Broken Arrow, TX (US)

(72) Inventors: Ronald J. Garr, Inola, OK (US); Brett C. Jones, Broken Arrow, OK (US); John D. Lindemann, Broken Arrow, OK (US); Michael L. Hair, Tulsa, OK (US); Thomas S. Myerley, Broken Arrow, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 510 days.

(21) Appl. No.: 14/329,331

(22) Filed: Jul. 11, 2014

(65) Prior Publication Data

US 2016/0010431 A1 Jan. 14, 2016

(51) Int. Cl.

| | |
|---|---|
| ***E21B 34/00*** | (2006.01) |
| ***E21B 41/00*** | (2006.01) |
| ***E21B 34/14*** | (2006.01) |
| ***E21B 34/10*** | (2006.01) |

(52) U.S. Cl.

CPC ..... *E21B 41/00* (2013.01); *E21B 34/00* (2013.01); *E21B 34/10* (2013.01); *E21B 34/14* (2013.01)

(58) Field of Classification Search

CPC ..... E21B 41/00; E21B 34/10; E21B 34/06; E21B 34/14; E21B 43/11; E21B 17/00; B26D 1/00; F16K 17/14

See application file for complete search history.

(56) References Cited

U.S. PATENT DOCUMENTS

| | | | | |
|---|---|---|---|---|
| 2001/0000379 | A1 | 4/2001 | Cooper et al. | |
| 2007/0277980 | A1 | 12/2007 | Gordon et al. | |
| 2008/0178938 | A1 | 7/2008 | Stokes et al. | |
| 2012/0037360 | A1 | 2/2012 | Arizmendi et al. | |
| 2013/0126184 | A1* | 5/2013 | Gerrard | E21B 34/08 166/373 |
| 2013/0133897 | A1* | 5/2013 | Baihly | E21B 34/063 166/376 |
| 2014/0096973 | A1 | 4/2014 | Lopez | |

OTHER PUBLICATIONS

"Piston Bore Puncture Communication Tool"; Schlumberger, 2009; www.SLB.com/completions; 1 page.

Notification of Transmittal of the International Search Report and the Written Opinion of the International Searching Authority, or the Declaration; PCT/US2015/033506; Mail Date: Aug. 13, 2015: 13 pages.

* cited by examiner

*Primary Examiner* — Yong-Suk (Philip) Ro
(74) *Attorney, Agent, or Firm* — Cantor Colburn LLP

(57) ABSTRACT

A penetrator for a Puncture Communication Tool includes a base; a body extending from the base and terminating at a tip; and a fluid bypass disposed in the body. Communicating a hydraulic chamber.

18 Claims, 2 Drawing Sheets

Concave

Cut

Tool Radius Cut

Cross-Drilled

Drilled

PENETRATOR FOR A PUNCTURE COMMUNICATION TOOL AND METHOD

BACKGROUND

In the downhole industry, control of flow is critical to a compliant operation. Many different valves and safeties have been and are employed to ensure well control. One such device is a Surface Controlled Subsurface Safety Valve (SCSSV). These are often installed during completion of the well and function to provide rapid valve closing under various preselected conditions or upon command from a command center, which may be at surface. Over time, the SCSSV may experience deterioration due to a number of factors and it may then become desirable to replace its function with a replacement valve such as a wireline insert SCSSV. In such case, the control line that had operated the original SCSSV would be accessed to provide controllable hydraulic fluid pressure to the insert SCSSV. Normally this is affected by using a puncture communication tool. It is to be understood that an SCSSV is only an example of the type of tool that might use a puncture communication tool. Any other tool where communication to a hydraulic fluid chamber is also contemplated. Such a tool is illustrated in prior art FIGS. 1 and 2, in a run-in and an actuated position, respectively. This device is well known to the art and commercially available from Baker Hughes Incorporated, Houston Tex. It is therefore not necessary to consider the Figures in detail but rather suffices to note that a ramp 10 is visible in both Figures but in a different position. The positional change in the ramp causes a penetrator assembly 12 to move radially thereby causing a penetrator 14 to puncture a hydraulic fluid chamber 16.

While the Puncture communication tool of the prior art serves its purpose well, it requires that the penetrator 14 be retracted to ensure that the hydraulic fluid chamber has been successfully breached. This is verified by a pressure change registered remotely such as at the surface. Because the penetrator itself may effectively plug the opening the penetrator creates, there may be insufficient pressure change (drop or rise if tubing pressure is higher than hydraulic cylinder pressure at that time) to be measured at surface hence the requirement for retracting the penetrator to verify its action. In the event successful penetration was not achieved, the Puncture Communication Tool would have to be re-actuated and placement might not be exactly the same or the tool might be tripped out for redress simply to avoid damage. Moreover, it is possible that the penetrator will be broken during the retraction which will require a trip to surface to replace the penetrator at least.

As one of skill in the art is painfully aware, any additional actions required for any well function come at an exquisitely high price in terms of equipment to perform the action, loss of production, etc. Accordingly, the art is always receptive to improvements in processes and tools to improve efficiency

BRIEF DESCRIPTION

A penetrator for a Puncture Communication Tool includes a base; a body extending from the base and terminating at a tip; and a fluid bypass disposed in the body.

A method for communicating a hydraulic chamber includes urging a penetrator through a wall of a hydraulic chamber to penetrate into the hydraulic chamber; registering a pressure change in the hydraulic chamber without retracting the penetrator.

BRIEF DESCRIPTION OF THE DRAWINGS

The following descriptions should not be considered limiting in any way. With reference to the accompanying drawings, like elements are numbered alike.

DETAILED DESCRIPTION

Referring to FIGS. 3-7 simultaneously, one of skill in the art will understand the overarching functional requirement of facilitating immediate fluid communication through the various penetrator 14 configurations upon breach of the hydraulic chamber 16. In each case, a fluid bypass is created even if the penetrator 14 itself remains in the breach that it created in the hydraulic chamber 16.

Figure 1:
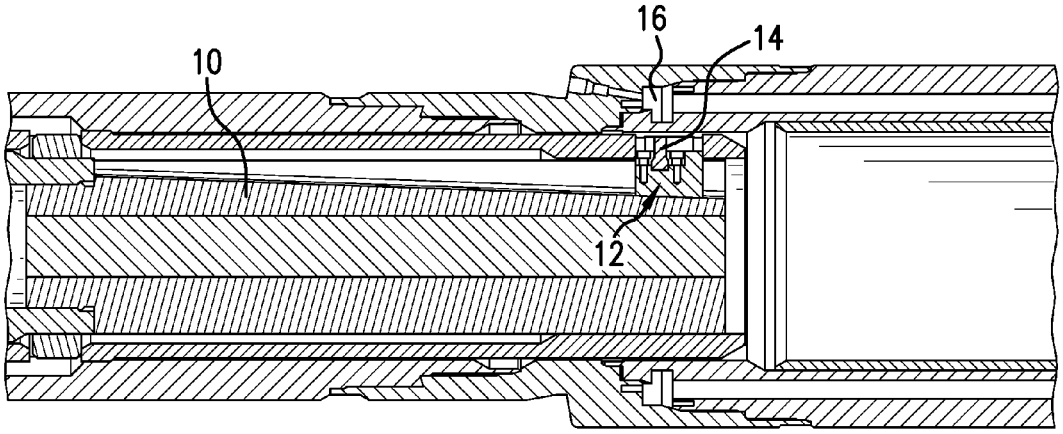
FIG.1 (PRIOR ART)
FIG. 1 is a cross sectional view of a portion of a prior art Puncture Communication Tool in a run in position.
Figure 2:
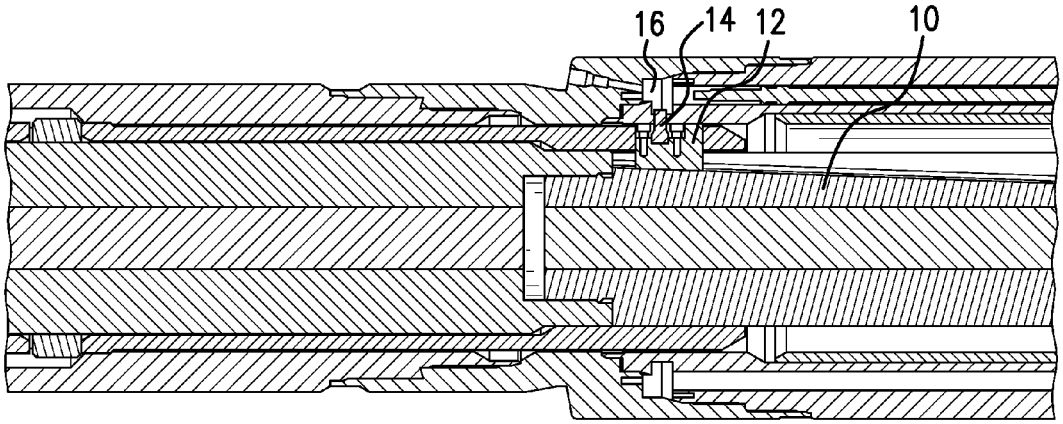
FIG.2 (PRIOR ART)
FIG. 2 is a cross sectional view of the portion of a prior art Puncture Communication Tool of FIG. 1 in an actuated position.
Figure 3:
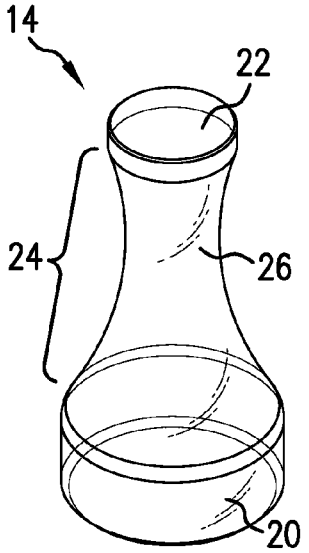
FIG. 3 is a perspective view of a penetrator as described herein.

Referring to FIG. 3, a first embodiment of the penetrator 14 is illustrated in a perspective view. The Penetrator 14 includes a base 20 and a tip 22. The base 20 is of a greater area than the tip 22 more for convenience than for function as the base will interact with the prior art Puncture Communication Tool in the same way that the prior art penetrator did. The tip 22 is configured (shaped and dimensioned) to create the hole into the hydraulic chamber.

Importantly to the embodiment is the configuration of the section between the base and the tip, given the moniker herein of "body" 24. The body 24 is roughly hourglass shaped, with the thinnest portion denoted neck 26. Precisely how radically the hourglass shape is shaped relates to both fluid passage desired and strength of the penetrator 14. The two considerations are juxtaposed to one another. More particularly, the more extreme the hourglass shape (narrower the neck), the more fluid flow is achievable but the weaker the penetrator simply because the amount of material that makes up the smallest diameter along the hourglass shape will be the weak link. Fluid flow will be greater because an annulus formed between the puncture size in the hydraulic chamber (dictated by the tip dimensions) and the neck 26 of the hourglass will have a larger annular dimension as the neck diameter decreases.

Figure 4:
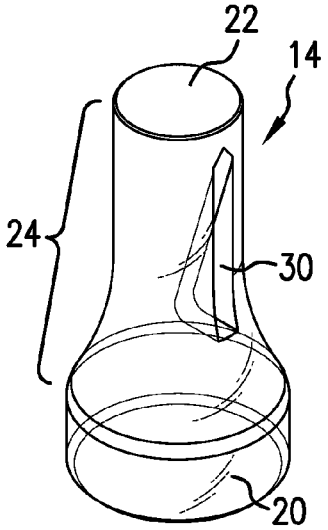
FIG. 4 is a perspective view of a penetrator as described herein.
Figure 5:
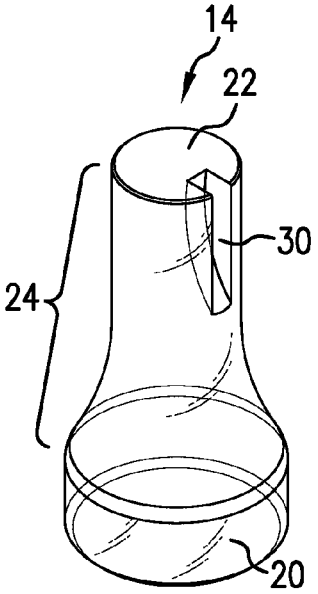
FIG. 5 is a perspective view of a penetrator as described herein.

In two other illustrated embodiments, referring to FIGS. 4 and 5, the penetrator 14 comprises base 20 and tip 22 as in FIG. 3 but body 24 is distinct. Body 24 comprises a flared frustoconical structure beginning at the base 20 and ending at the tip 22. This shape is very similar to the prior art penetrator but in the invention, the body 24 is also provided with one or more recesses 30 therein (one illustrated) positioned through a side of the body 24. Such a recess is producible by any number of machining tools that are known to the art. Referring to FIG. 5, it will be appreciated that the recess 30 extends into the surface of tip 22 while that of FIG. 4 does not extend to the surface of tip 22. In either case, the recess 30 provides a fluid pathway through which fluid in the hydraulic chamber 16 may escape thereby facilitating a pressure change thereby confirming penetration of the penetrator in to the hydraulic chamber 16. Communication with the control line is hence assured.

Figure 6:
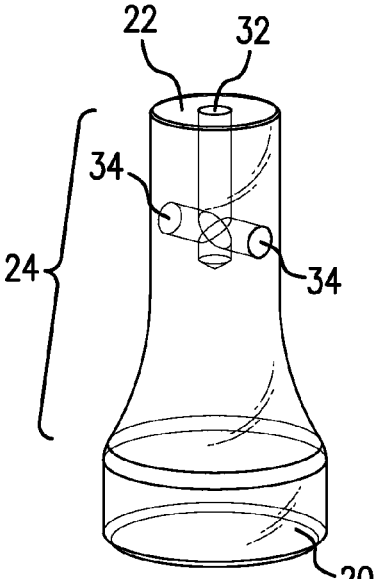
FIG. 6 is a perspective view of a penetrator as described herein.

In another embodiment hereof, referring to FIG. 6, the penetrator 14 includes one or more passageways 32 through tip 22 and into body 24. While the one or more passageways 32 is illustrated to originate at tip 22 and extend coaxially with penetrator 14, it need not be so positioned. The opening could be off center and the one or more passageways would be off center and parallel with the axis of penetrator 14 or could be nonparallel with the axis of penetrator 14. The depth of the one or more passageways 32 into body 24 is variable. The one or more passageways 32 is intersected with one or more cross passageways 34 that vent the passageway 32 to a surface of body 24. Although the cross passageways 34 in FIG. 6 are positioned orthogonally to passageway 32, they can be positioned at any angle that allows the fluid in passageway 32 to vent to a surface of body 24. Also, although a single cross passageway is drilled diametrically across body 24, it is noted that the cross passageway 34 could be radially positioned to extend from the passageway 32 to one side of the body 24 instead of both sides. There can also be more cross passageways and they may be at any angle.

Figure 7:
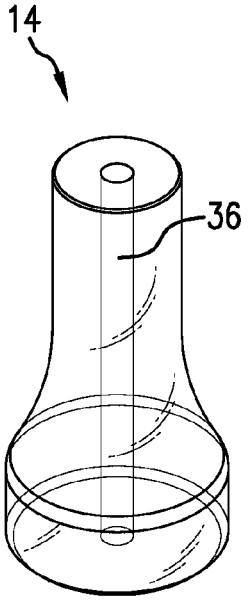
FIG. 7 is a perspective view of a penetrator as described herein.

Finally, referring to FIG. 7, another alternate embodiment presents one or more through bore 36 from tip 22 to base 20. The one or more through bores may be of varied diameter and can be positioned coaxially or non-coaxially with the penetrator 14. In the case of one or more through bores being non-coaxial, they or it may be in parallel to the axis or may be nonparallel with the axis. In each embodiment fluid will pass the penetrator upon puncturing the hydraulic chamber thereby allowing a pressure change to be perceivable remotely to confirm puncture.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A Puncture and Communication Tool, comprising:

a ramp axially translatable within a tubular structure of a wellbore system;

a penetrator in operable communication with the ramp, the penetrator responsive to axial translation of the ramp to extend radially to breach a hydraulic fluid chamber of the tubular structure, the penetrator including:

a penetrator base;

a penetrator body extending from the base and terminating at a penetrator tip; and a fluid bypass disposed in the penetrator body.

2. A puncture and communication tool as claimed in claim 1 wherein the fluid bypass is a narrowed neck of the body.

3. A puncture and communication tool as claimed in claim 1 wherein the body is hourglass shaped.

4. A puncture and communication tool as claimed in claim 1 wherein the fluid bypass is one or more recesses in the body.

5. A puncture and communication tool as claimed in claim 1 wherein the recess is positioned in the side of the body.

6. A puncture and communication tool as claimed in claim 1 wherein the recess extends to the tip.

7. A puncture and communication tool as claimed in claim 1 wherein the fluid bypass includes one or more passageways extending from the tip toward the base and intersecting one or more cross passageways extending from a side of the body.

8. A puncture and communication tool as claimed in claim 7 wherein the one or more passageways are one or more of coaxial and non-coaxial with the body.

9. A puncture and communication tool as claimed in claim 7 wherein the one or more cross passageways are orthogonally positioned relative to the body.

10. A puncture and communication tool as claimed in claim 1 wherein the fluid bypass is one or more through bores extending from the tip to the base.

11. A puncture and communication tool as claimed in claim 10 wherein the one or more through bores are one or more of coaxial and non-coaxial with the body.

12. A puncture and communication tool as claimed in claim 1 wherein one or more of the one or more through bores are parallel.

13. A method for communicating a hydraulic chamber with a puncture and communication tool as claimed in claim 1 comprising:

urging the penetrator through a wall of a hydraulic fluid chamber to penetrate into the hydraulic fluid chamber;

registering a pressure change in the hydraulic fluid chamber without retracting the penetrator.

14. A method as claimed in claim 13 wherein fluid flow causing the pressure change flows through a fluid bypass of the penetrator.

15. A method as claimed in claim 14 wherein the fluid bypass is one or more recesses.

16. A method as claimed in claim 13 wherein the fluid bypass is one or more through bores.

17. A method as claimed in claim 13 wherein the fluid bypass is one or more passageways and cross passageways.

18. A method as claimed in claim 13 wherein the fluid bypass is a narrower neck portion of a body of the penetrator.

* * * * *